US006295650B1

(12) United States Patent
Baacke

(10) Patent No.: US 6,295,650 B1
(45) Date of Patent: Oct. 2, 2001

(54) UPLAND PACK VEST

(76) Inventor: Dennis R. Baacke, W4665 County Rd. J, Irma, WI (US) 54442

( * ) Notice: Subject to any disclaimer, the term of this patent is extended or adjusted under 35 U.S.C. 154(b) by 0 days.

(21) Appl. No.: 09/678,721

(22) Filed: Oct. 4, 2000

(51) Int. Cl.[7] ..... A41D 1/04
(52) U.S. Cl. ..... 2/94; 2/462; 224/921
(58) Field of Search ..... 2/94, 461, 462, 2/463, 467, 44, 45, 92, 102, 327, 247, 253; 224/259, 600, 921; 182/3

(56) References Cited

U.S. PATENT DOCUMENTS

| | | | | |
|---|---|---|---|---|
| 840,332 | * | 1/1907 | Howard et al. | 224/216 |
| 2,485,442 | * | 10/1949 | Halliday | 2/94 |
| 2,967,307 | * | 1/1961 | O'Donnell | 2/253 |
| 4,669,127 | * | 6/1987 | Swanson | 2/46 |
| 4,676,418 | * | 6/1987 | Lowe | 224/215 |
| 5,014,359 | * | 5/1991 | Hanson | 2/94 |
| 5,114,059 | * | 5/1992 | Thatcher | 224/209 |
| 5,619,751 | * | 4/1997 | Ray et al. | 2/102 |
| 5,634,579 | * | 6/1997 | Baclawski | 224/637 |
| 5,673,836 | * | 10/1997 | Bush | 224/576 |
| 5,890,809 | * | 4/1999 | Nelson | 224/581 |
| 5,909,802 | * | 6/1999 | Puco et al. | 2/102 |
| 5,913,409 | * | 6/1999 | Test | 2/102 |

* cited by examiner

*Primary Examiner*—John J. Calvert
*Assistant Examiner*—Tejash Patel
(74) *Attorney, Agent, or Firm*—Boyle, Fredrickson , Newholm, Stein & Gratz, S.C.

(57) ABSTRACT

An upland pack vest for hunting has a rear game pouch and an adjustable belting/strapping system designed to evenly distribute the weight of game loaded in the game pouch. The pack vest includes a pair of shoulder staps connected to the top of the game pouch and a hip belt connected to the inside of the game pouch. The shoulder straps are hung over the shoulders of the hunter and the hip belt is buckled around the waist of the hunter. A pair of adjustable diagonal straps connect the respective shoulder straps to the game pouch. A sternum strap connects the shoulder straps to prevent the shoulder straps from spreading as the adjustable diagonal straps redistribute weight from the game pouch onto the front portion of the shoulder straps. The length of the diagonal straps are adjustable in order to allow the hunter to adjust the fit of the vest.

18 Claims, 4 Drawing Sheets

FIG. 8
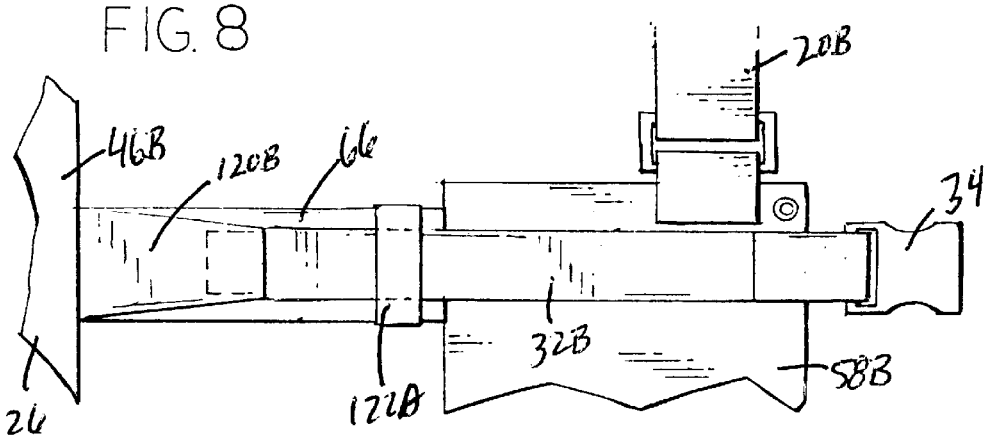
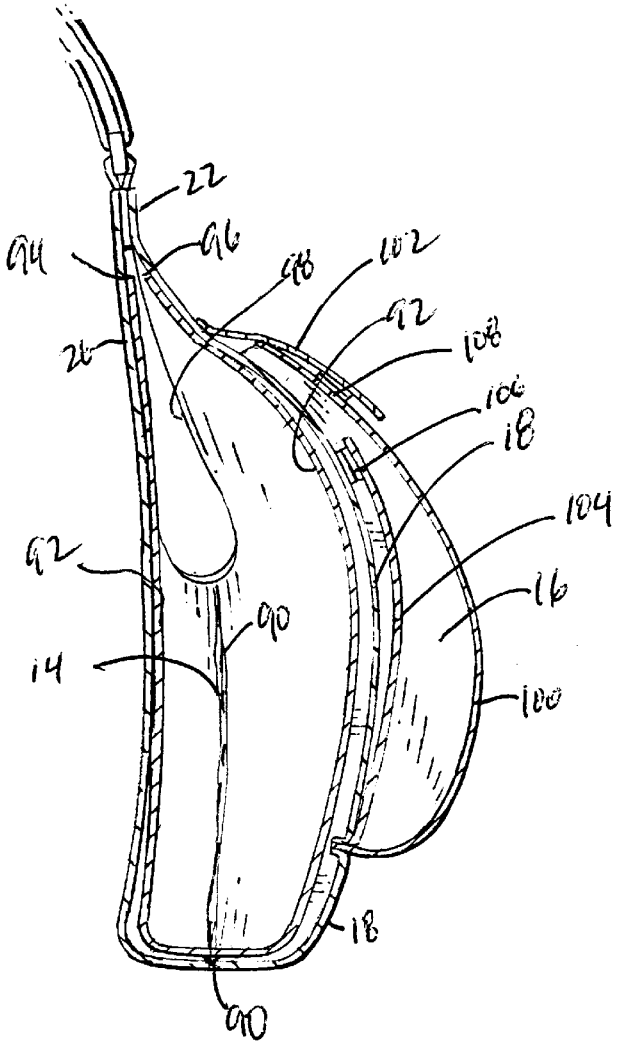
FIG. 9

UPLAND PACK VEST

BACKGROUND OF THE INVENTION

The demands of bird hunting have stimulated improvements in game vests, which have become commonly referred to as upland vests. Hunters use upland vests to carry provisions and supplies for the hunting expedition (e.g., food, water, ammunition, tools, etc.) as well as game. Typically, game is loaded into a rear game pouch. Such vests must be versatile and durable to meet the demands of hunters. It is also important that the vest be comfortable throughout the hunting expedition, including both before and after loading game in the vest.

Some previously known backpack-type vests use a crude combination of the shoulder straps and hip belt to provide load support. However, as loads change during the hunting expedition, the prior art vests often become cumbersome and uncomfortable. For example, some hunters like the load to swing slightly relative to the body with each stride.

Hunters can normally carry heavy loads for a longer period of time, with less fatigue and greater comfort if the load is supported by the lumbar region and movable, within limits, so that the body does not jerk the vest through a series of forceful oscillations corresponding to the walking or running rhythm.

On the other hand, it is important that the swing movement be adjustable to the particular characteristics of the load and the hunter. Every person has a slightly different body build, muscle distribution, and stride characteristics. Even the same person may prefer changing the adjustment of his vest assembly from time-to-time, in order to switch the load slightly from one set of muscles to another.

Prior art upland vests having rear game pouches tend to become tail heavy when game is loaded into the rear game pouch. When this happens, the vest tends to ride low. Those skilled in the art have attempted to overcome this problem by using a hip belt. One of the problems with hip belts is that an inordinate amount of weight is supported on the hip belt, and this is uncomfortable. Without hip belts, however, virtually all of the weight of the pack belt is on the shoulders, and the backpack slides backwards.

It is, therefore, an object of this invention to provide a comfortable upland vest with a rear game pouch that allows the hunter to adjust and stabilize the load while hunting.

SUMMARY OF THE INVENTION

The invention is an upland pack vest that uses a unique combination of adjustable straps in order to allow the distribution of weight in a loaded rear game pouch between the shoulder straps and the hip belt. The invention uses a pair of diagonal straps to accomplish this advantage. Each diagonal strap connects one of the shoulder straps at a location below the sternum to the rear panel of the pack vest in the vicinity of the rear game pouch. In this manner, the load within the game pouch can be redistributed onto the shoulder straps so that the majority of the weight in the game pouch is evenly balanced on the shoulder straps. A sternum strap connects the shoulder straps to prevent the shoulder straps from separating. In the preferred embodiment of the invention, the length of the diagonal straps is adjustable in order to enable the hunter to easily redistribute the load in the rear game pouch onto the front part of the shoulder straps.

The upland pack vest is provided with compartments to provide easy access to water bottles, ammunition, hunting tools, food, clothes and other hunting accessories. The upland pack vest preferably includes a pair of front pocket assemblies that are normally used for carrying ammunition or other hunting accessories. In accordance with the preferred embodiment of the invention, the front pocket assemblies are separated from the hip belt, and hang freely or float relative to the shoulder straps and the hip belts. A quick release connection strap between the freely hanging front pockets is preferably used to prevent the front pockets from excessive swinging.

Preferably, adjustable compression straps are connected to the outer panel of the rear game pouch in order to enable the hunter to carry clothing or other bulky items outside of the game pouch. Also, it is preferred that the sternum strap be attached to the shoulder straps in such a manner that the height of the sternum strap is adjustable. This feature is useful because hunters have various sized torsos, and is so particularly useful when the upland pack vest is used by women. The adjustable eight sternum strap allows women to locate the sternum strap above their breasts.

Other features and advantages of the invention may be apparent to those skilled in the art upon inspecting the following drawings and description thereof.

BRIEF DESCRIPTION OF THE DRAWINGS

FIG. 8 is a detailed view of a portion of the hip belt for the upland pack vest as viewed from lines 8—8 in FIG. 7.

FIG. 9 is a vertical section view of the rear game pouch in the upland pack vest as taken along line 9—9 in FIG. 3.

DETAILED DESCRIPTION OF THE INVENTION

Figure 2:
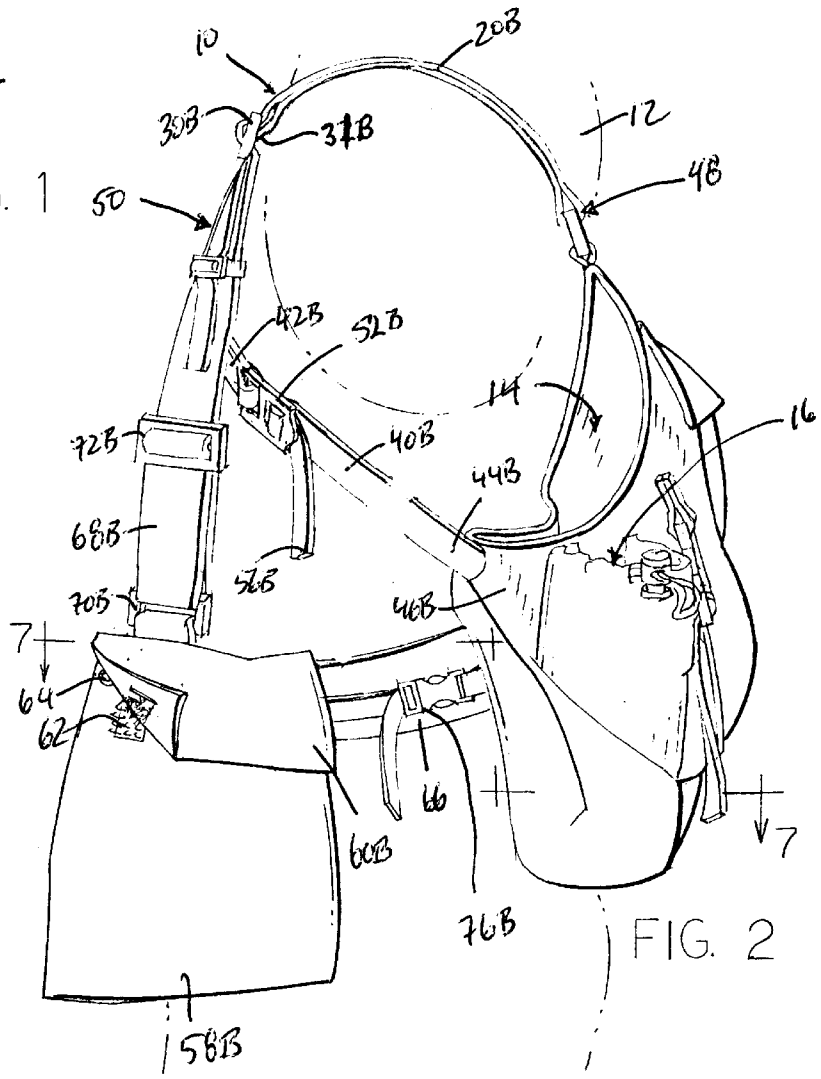
FIG. 2 is a side elevational view of the upland pack vest shown in FIG. 1 also showing the body of a hunter in phantom.
Figure 1:
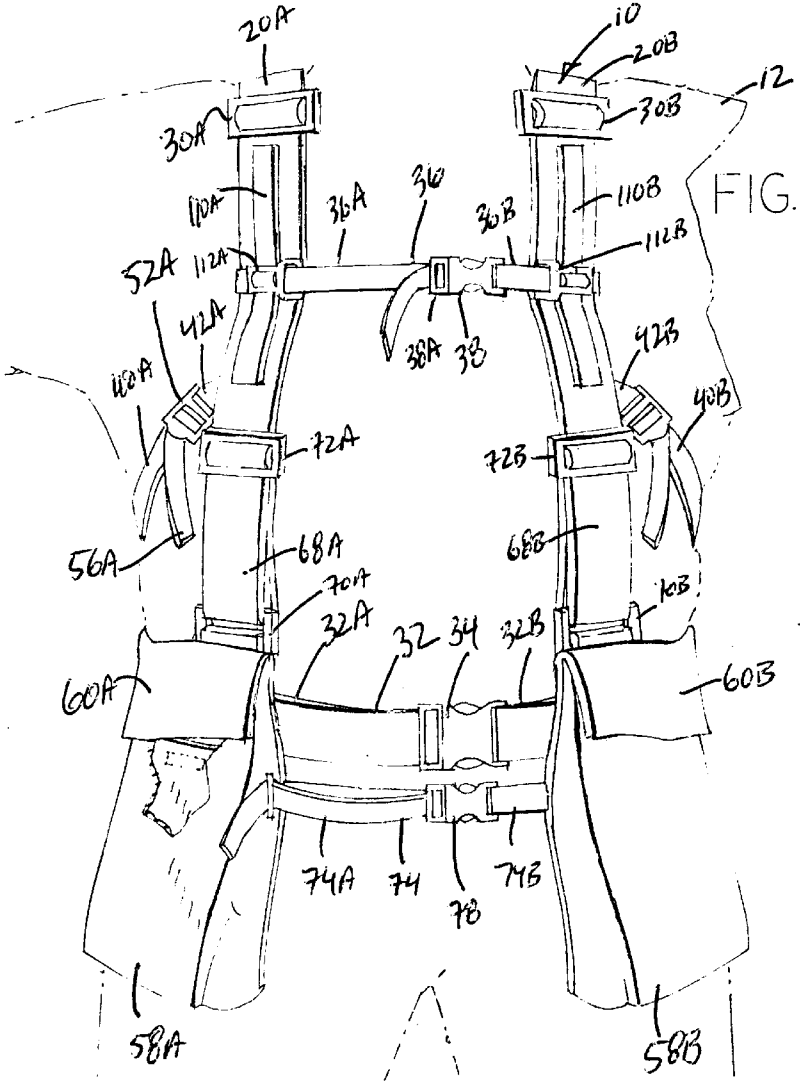
FIG. 1 is a front view of a pack vest constructed in accordance with the referred embodiment of the invention, showing the body of a hunter in phantom.
Figure 3:
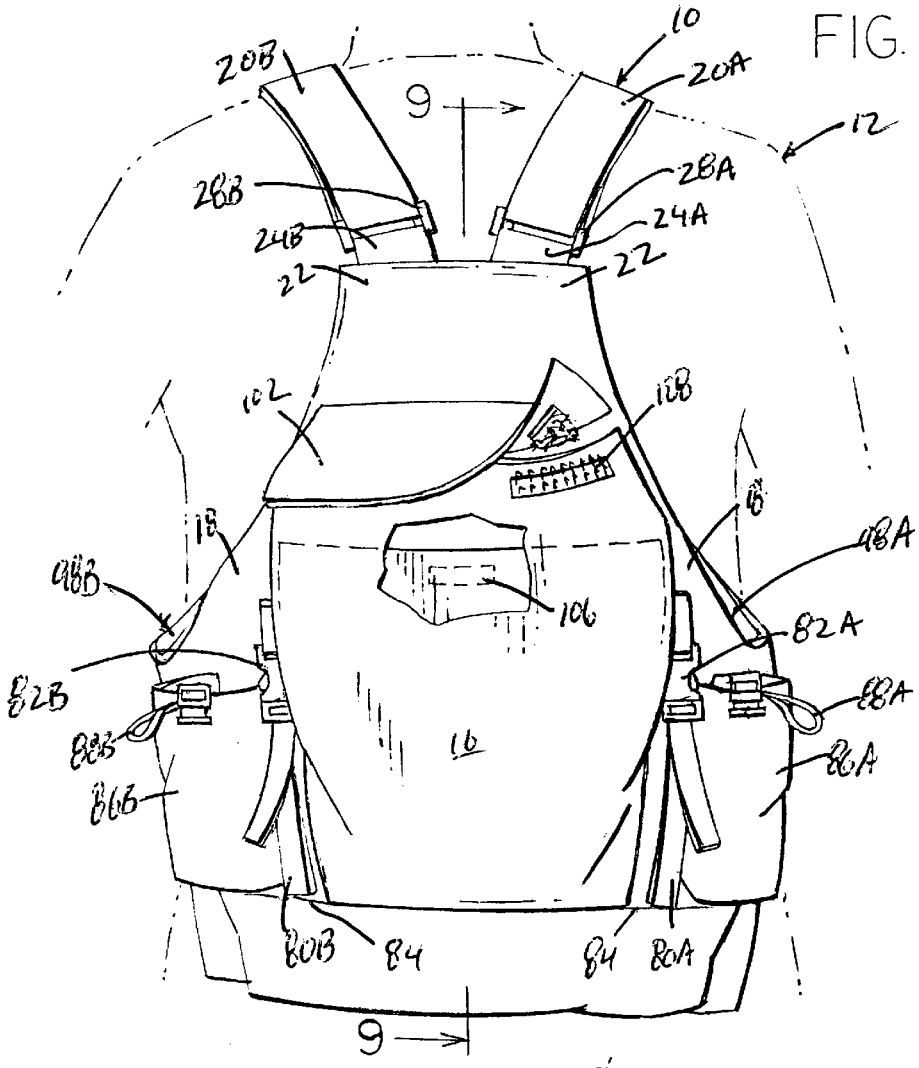
FIG. 3 is a rear elevational view of the upland pack vest shown in FIGS. 1 and 2 also showing the body of a hunter in phantom.

The drawings illustrate an upland pack vest 10 constructed in accordance with the preferred embodiment of the invention. In FIGS. 1–3, the upland pack vest 10 is shown as being worn on the body of a hunter 12 (shown in phantom). Referring first to FIGS. 1–3, the upland pack vest 10 includes a rear game pouch 14, FIG. 2, and a rear cargo pouch 16. The rear game pouch 14 and the rear cargo pouch 16 are separated by a fabric panel 18, as will be discussed in more detail below with respect to FIG. 9.

The pack vest includes a pair of adjustable shoulder straps 20*a*, 20*b*. In the rear of the vest 10 (FIG. 3), the shoulder straps 20*a*, 20*b* are connected at the top 22 of the rear portion of the vest 10. Preferably, the shoulder straps 20*a*, 20*b* are connected to the top 22 of the rear portion of the vest 10 by sewing loops of strapping 24*a*, 24*b* between the top portion 22 of the main panels of fabric 18, 26 (FIG. 9) for the rear portion of the vest 10. Plastic strap connectors 28*a*, 2*8b* are secured within the loops of strapping 24*a*, 24*b*. The shoulder straps 20*a*, 20*b* are looped through the brackets 28*a*, 28*b*, respectively. The brackets 28*a*, 28*b* allow for movement of the shoulder straps 20*a*, 20*b* as the length of the shoulder straps is adjusted.

Each shoulder strap 20*a*, 20*b* includes an upper length adjustment bracket 30*a*, 30*b*. The upper length adjustment brackets 30*a*, 30*b* for the shoulder strap 20*a*, 20*b* are preferably made of molded plastic and are of the type conventionally used in the art. More specifically, the length adjustment brackets 30*a*, 30*b* each include two slots through which the respective shoulder strap 20*a*, 20*b* is threaded. A center rod (now shown) extends across the brackets 30*a*, 30*b* and separates the slots through which the shoulder strap passes. The distal end 3 lb (FIG. 2) of the shoulder strap 20*a*, 20*b* includes a sewn loop that attaches to the center rod of the bracket 30*a*, 30*b* in order to fix the strap 20*a*, 20*b* to the respective bracket 30*a*, 30*b*. The length of the shoulder straps 20*a*, 20*b* can be adjusted easily by the user by moving the bracket 30*a*, 30*b* either upward or downward along the front portion of the strap 20*a*, 20*b*. The adjustability of the length of the shoulder straps 20*a*, 20*b* is important for adjusting the tightness of the pack vest 10 on the hunter 12, as well as adjusting load distribution.

The upland pack vest 10 also includes a hip belt 32. As will be described in more detail below with respect to FIG. 7, the hip belt 32 includes two straps 32*a*, 32*b* which are connected in the rear to an inside lower portion of the vest 10. The hip belt straps 32*a*, 32*b* are connected to each other around the waist of the hunter 12 via a quick release buckle 34. Strap 32*a* is preferably adjustable in length.

The upland pack vest 10 also includes a sternum strap 36 connecting the shoulder straps 20*a*, 20*b*. The sternum strap 36 includes strap portion 36*a* that is adjustably connected to shoulder strap 20*a*, and strap portion 36*b* that is adjustably connected to shoulder strap 20*b*. The length of strap portion 36*a* is adjustable. A buckle 38 is provided to connect the strap portions 36*a* and 36*b* of the sternum strap 36. Preferably, the side of the buckle 38 for the adjustable strap portion 36*a* includes a strap adjustment bracket 38*a*, as is known in the art. The height of the sternum strap 36 with respect to the shoulder straps 20*a*, 20*b* is adjustable as is discussed in more detail below with respect to FIGS. 5 and 6.

The vest 10 includes a pair of adjustable length diagonal straps 40*a*, 40*b*. The diagonal straps 40*a*, 40*b* have a first end 42*a*, 42*b* connected to the respective shoulder strap 20*a*, 20*b* at a location below which the sternum strap 36 is located. The adjustable diagonal straps 40*a*, 40*b* also include another end 44*b* (FIG. 2) that is connected to a rear portion 46*b* of the vest 10 in order to facilitate support of the rear game pouch 14 and rear cargo pouch 16. More specifically, the length of straps 40*a*, 40*b* is adjustable so that the hunter can redistribute the load at the rear of the vest 10 (e.g., the load within the rear game pouch 14 and the cargo pouch 16) from the rear portions 48 (FIG. 2) of the shoulder straps 20*a*, 20*b* to the front portions 50 (FIG. 2) of the shoulder straps 20*a*. Easy adjustment of the length of the diagonal straps 40*a*, 40*b* is provided through the use of plastic slide and lock brackets 52*a*, 52*b* connected to strapping loops 42*a*, 42*b* which are attached to the respective shoulder straps 20*a*, 20*b*.

The vest 10 also includes a pair of front pouches 58*a*, 58*b*. The front pouches 58*a*, 58*b* include a top flap 60*a*, 60*b* that covers a top opening of the pouches 58*a*, 58*b*. Preferably, hook and loop fastening material 62 is used to secure the flaps 60*a*, 60*b* over the pouches 58*a*, 58*b*. Although not shown specifically in the drawings, the front pouches 58*a*, 58*b* preferably each include two or more separate internal compartments. In this manner, fresh ammunition can be separated easily from other supplies or waste. Also preferably, it is desired that one of the front pouches 58*a*, 58*b* (include a hook for keys. FIG. 2 shows a button 64 which is used to tighten or loosen the top of the pouch 58*b*. Each front pouches 58*a*, 58*b* is connected to the rear portion 46*b* (FIG. 2) of the vest 10 by a longitudinal panel 66 of fabric. Each front pouches 58*a*, 58*b* is also suspended from a bottom portion 68*a*, 68*b* of a shoulder strap 20*a*, 20*b*. More specifically, the bottom portion 68*a*, 68*b* of the respective shoulder strap 20*a*, 20*b* is connected through a plastic bracket 70*a*, 70*b* to the top portion of the front pouches 58*a*, 58*b*. The lower portions 68*a*, 68*b* of the shoulder straps 20*a*, 20*b* include slide and lock adjustment brackets 72*a*, 72*b* in order to adjust the tension of the shoulder straps 20*a*, 20*b* with respect to the front pouches 58*a*, 58*b*. Preferably, the brackets 72*a*, 72*b* at the lower portion of the shoulder straps 20*a*, 20*b* are similar to the brackets 30*a*, 30*b* at the upper portion of the shoulder straps 20*a*, 20*b*. In order to prevent the front pouches 58*a*, 58*b* from swinging excessively as the pouches hang from the bottom portions 68*a*, 68*b* of the shoulder straps 20*a*, 20*b*, the vest 10 includes an adjustable length connecting strap 74 as well as pouch side straps 76*a*, 76*b* . The pouch connecting strap 74 includes straps 74*a* and 74*b*, as well as buckle 78. The strap 74*a* has an adjustable length, and the buckle 78 is preferably the same as the buckle 38 used with respect to the sternum strap 36. The side pouch strap 76*a*, 76*b* connects the respective front pouch 58*a*, 58*b* to the rear portion 46*a*, 46*b* of the vest 10, along the same path as the fabric panel 66. However, the adjustable length panel side strap 76*a*, 76*b* can be shortened with respect to the panel 66 in order to tighten the vest 10 around the waist of the hunter 12. Note that FIG. 2 shows the use of a quick release buckle in the side panel strap 76*b*. Alternatively, it might be desirable to replace the buckle with a strap slide having a frictional lock, without using a buckle.

Figure 4:
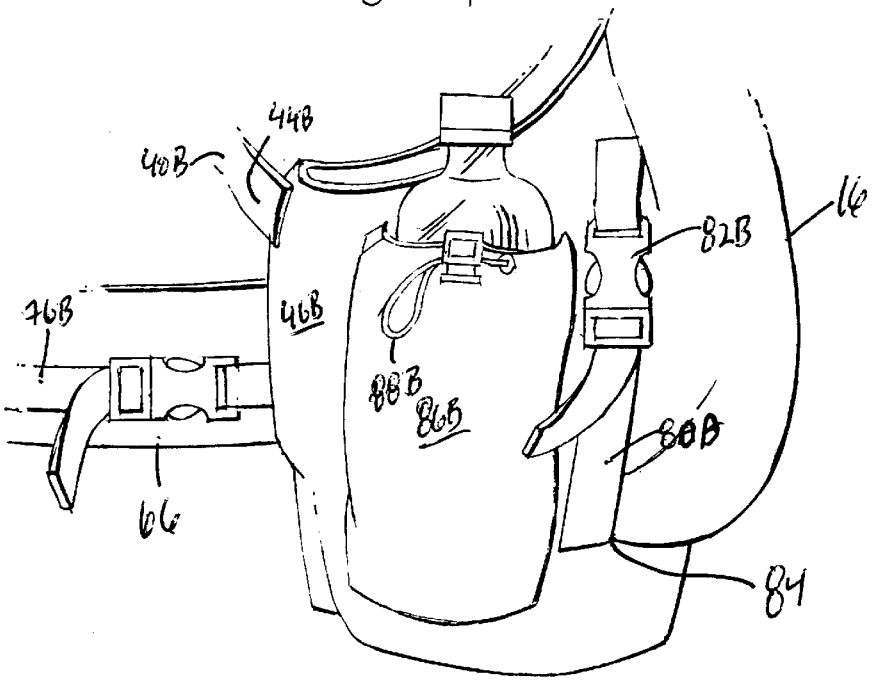
FIG. 4 is a detailed side elevational view of a portion of the upland pack vest shown in FIGS. 1–3.

Referring now specifically to FIGS. 2–4, the rear of the vest 10 preferably includes a pair of compression straps 80*a*, 80*b*. The compression straps 80*a*, 80*b* enable the hunter to carry clothing or other bulky items outside the game pouch. The adjustable compression straps 80*a*, 80*b* are each connected to a buckle 82*a*, 82*b*. The buckles 82*a*, 82*b* each have a portion attached to the outer rear panel 18 of the vest 10.

The other portion of the buckle 82*a*, 82*b* has a lockable strap slide. The bottom of the compression straps 80*a*, 80*b* are preferably connected at the seam 84 at the bottom of the cargo pouch 16.

Water bottle holding pouches 86*a*, 86*b* are sewn into the lateral portions of the rear of the vest 10 adjacent the compression straps 80*a*, 80*b*. Note that a lockable tightening string 88*a*, 88*b* is preferably provided at the top opening of the water bottle pouches 86*a*, 86*b*.

Referring now to FIG. 9, the rear game pouch 14 is formed between an inside panel of fabric 26 and an outside panel of fabric 18, which are connected along a seam 90 along the bottom and sides of the rear portion of the vest. A nylon lining 92 is provided inside of the rear game pouch 14. Preferably, the nylon lining is sewn to the vest only along the top edges 94, 96 and along the edges of the openings 98 into the game pouch 14. As shown best in FIG. 3, the game pouch includes two lateral openings 98*a*, 98*b*. Referring still to FIG. 9, the rear cargo compartment 16 is formed by sewing an outer panel 100 of fabric to the outer panel of fabric 18 for the game pouch 14. A fabric flap 102 is also attached to the outer panel 18 for the game pouch 14 to cover the open top of the rear cargo pouch 16. Preferably, another panel of material 104 is sewn within the rear cargo pouch 16 to form separate compartments within the rear cargo pouch 16. Hook and loop type fasteners 106 are preferably provided between the surface of the outer panel 18 of the game pouch 14 and the top of inner panel 104 for the cargo pouch 16. In addition, hook and loop type fasteners 108 are provided to seal the flap 102 against the outer panel 100 for the cargo pouch 16.

Figure 6:
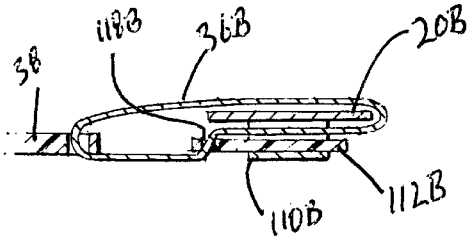
FIG. 6 is a detailed sectional view taken along line 6—6 in FIG. 5 showing an adjustable connection for the sternum strap on the shoulder strap.
Figure 5:
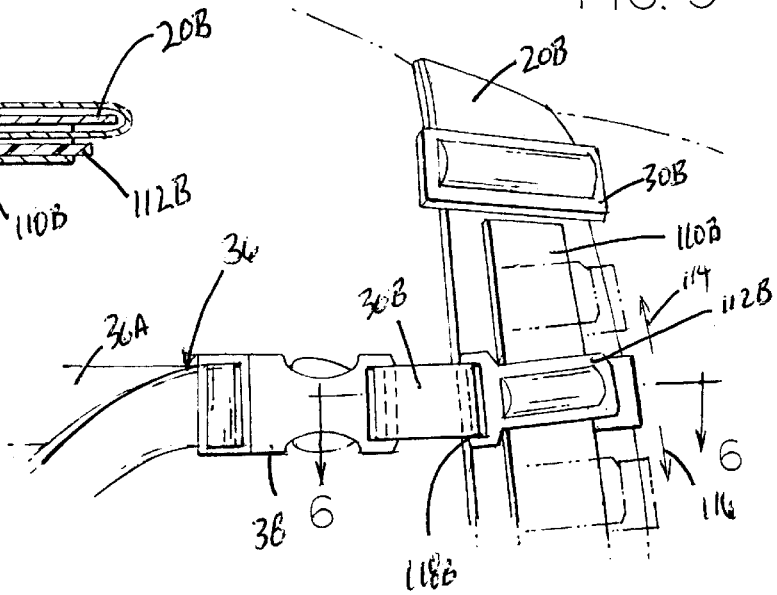
FIG. 5 is a detailed view showing a sternum strap connected to a shoulder strap in the upland pack vest shown in FIGS. 1 through 3.

Referring now to FIGS. 5 and 6, each shoulder strap 20*a*, 20*b* includes a longitudinal positioning strap 110*a*, 110*b* for connecting the sternum strap 36 to the shoulder straps 20*a*, 20*b*. The ends of each longitudinal positioning strap 110*a*, 110*b* are sewn to the respective shoulder strap 20*a*, 20*b* such that the middle portions of the longitudinal positioning straps 100*a*, 100*b* are free from the shoulder straps 20*a*, 20*b*. A slidable connection bracket 112*a*, 112*b* is secured to the respective longitudinal positioning strap 110*a*, 110*b* and is able to be moved along the respective strap 110*a*, 110*b* as depicted by arrows 114, 116 in FIG. 5. The sternum strap 36*a*, 36*b* is fed through an eyelet 118*b* in the slide bracket 112*b* and then looped around the shoulder strap 20*b*. The arrangement is similar with respect to the connection to shoulder strap 20*a*. In this manner, the sternum strap 36 can be raised or lowered with respect to the shoulder straps 28*a*, 20*b*, respectively. Movement of the sternum strap 36 during use is improbable because of frictional engagement between the brackets 112 and the longitudinal positioning strap 110.

Figure 7:
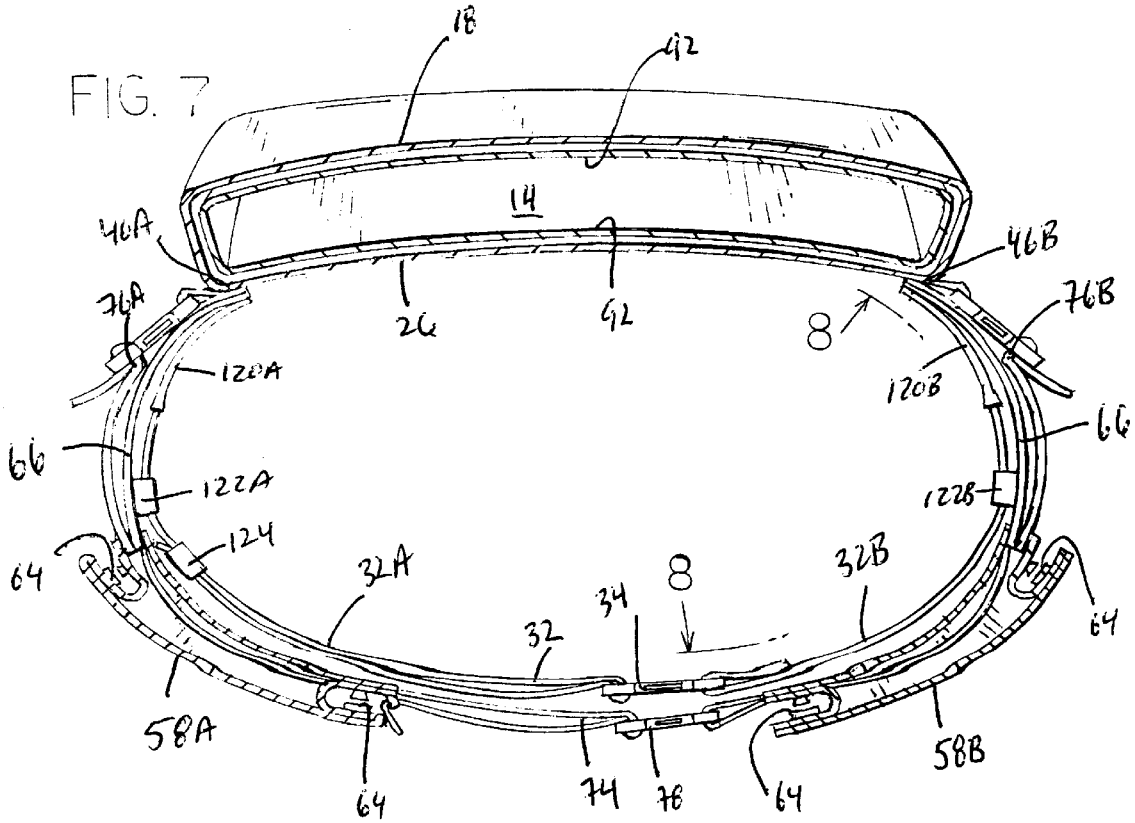
FIG. 7 is a sectional view of the upland pack vest taken along line 7—7 in FIG. 2.

Referring now to FIGS. 7 and 8, the hip belt straps 32*a*, 32*b* are connected to the lower portions 46*a*, 46*b* of the rear portion of the vest, and preferably to the lower portion of the inside panel 26 of the game vest, via fabric leads 120*a*, 120*b* that are connected to the lower portion of the rear panel 26. The belt portions 32*a*, 32*b* are each held by belt loops connected to the fabric panel 66. Note that hip belt strap 32*a* includes slot 124 for adjustment of the strap 130.

The invention has been described herein with respect to a preferred embodiment of the invention.

However, various alternatives and other embodiments are contemplated as being within the scope of the following claims which particularly point out and distinctly claim the subject matter regarded as the invention.

I claim:

1. An upland pack vest for hunting comprising:

a rear game pouch formed between an inside panel and an outer panel;

an opening between an upper portion of the inside panel and an upper portion of the outer panel that enables game to be loaded into the rear game pouch while hunting;

a pair of shoulder straps connected to a top of a rear portion of the vest;

a pair of front pouches connected to the vest below the respective shoulder straps, wherein the pair of shoulder straps connect to the front pouches to support the pouches;

a hip belt connected to the inside panel of the game pouch at a location lower than the location where the shoulder straps are connected to the game pouch, wherein the hip belt has a buckle and the length of the hip belt is adjustable;

a sternum strap connecting the shoulder straps; and at least one adjustable diagonal strap connecting one of the shoulder straps to the game pouch, the adjustable diagonal strap having a first end connected to the shoulder strap at a location below the location where the sternum strap is connected to the shoulder strap, and a second end connected to the rear portion of the vest in order to facilitate support of the rear game pouch.

2. An upland pack vest for hunting as recited in claim 1 wherein the opening in the rear game pouch is a first opening on a first upper lateral portion of the pack vest and the pack vest further comprises:

a second opening between an upper portion of the inside panel and an upper portion of the outer panel that enables game to be loaded into the pouch while hunting.

3. An upland pack vest for hunting as recited in claim 2 wherein the adjustable diagonal strap is a first adjustable diagonal strap and the pack vest further comprises:

a second adjustable diagonal strap having a first end connected to the second pair of the shoulder straps at a location below the location where sternum strap is connected to the shoulder strap, and a second end connected to the rear portion of the vest in order to facilitate support of the rear game pouch.

4. An upland pack vest for hunting as recited in claim 1 wherein the sternum strap connects the shoulder straps; and the pack vest further comprises:

a sternum strap that has a buckle that not only locks, but allows the sternum strap to have adjustable length; and the sternum strap that has a bracket on the respective shoulder straps, thereby allowing the sternum strap to be adjustable in height along the pair of shoulder straps.

5. An upland pack vest for hunting as recited in claim 4 further comprising a pair of longitudinal positioning straps for connecting the sternum strap to the shoulder straps, each longitudinal positioning strap having the first end connected to the respective shoulder strap in the vicinity where the shoulder strap is connected to the top of the game pouch, and a second end connected to the shoulder strap in the vicinity where the respective diagonal strap is connected to the shoulder strap.

6. An upland pack vest for hunting as recited in claim 1 wherein the shoulder straps are adjustable in length allowing the hunter to raise or lower the game pouch along his back.

7. An upland pack vest for hunting as recited in claim 6 wherein the shoulder straps have a slide strap allowing the hunter to adjust the shoulder strap and lock the shoulder straps at the adjusted position.

8. An upland pack vest for hunting as recited in claim 1 further comprising an adjustable position strap for connecting the shoulder straps to the front pouches, thereby allowing the hunter to raise or lower the front pouches in the longitudinal axis.

9. An upland pack vest for hunting as recited in claim 1 further comprising a key hook within at least one of the front pouches.

10. An upland pack vest for hunting as recited in claim 1 wherein the front pouches have more than one compartment.

11. An upland pack vest for hunting as recited in claim 1 further comprising water bottle holders connected to the outside panel of the game pouch at a location lower than the location where the shoulder straps are connected to the game pouch.

12. An upland pack vest for hunting as recited in claim 1 further comprising a cargo storage pouch connected to the outer portion of the game pouch at a location below the location where the shoulder straps are connected to the game pouch.

13. An upland pack vest for hunting as recited in claim 1 wherein the inside layer of the game pouch has a liner made of a water-resistant material.

14. An upland pack vest for hunting as recited in claim 1 further comprising a slidable strap lock for the adjustable diagonal strap, the slidable strap lock being located in close proximity to the respective shoulder strap thereby allowing the hunter to vary the length of the diagonal strap and stabilize the game pouch as the load changes while hunting.

15. An upland pack vest for hunting as recited in claim 14 further comprising a slidable clip attached along one end of the adjustable diagonal strap thereby allowing the hunter to clip the tail of the adjustable diagonal strap to a main portion of the adjustable diagonal strap.

16. An upland pack vest for hunting as recited in claim 1 further comprising adjustable compression straps connected to the outer panel of the game pouch.

17. An upland pack vest for hunting as recited in claim 16 wherein the adjustable compression straps have quick release buckles.

18. An upland pack vest for hunting as recited in claim 16 wherein each adjustable compression strap has a first end connected to the lower portion of the game pouch and a second end connected in the vicinity of the opening of the game pouch.

* * * * *